US007281968B2

(12) United States Patent
Takado

(10) Patent No.: US 7,281,968 B2
(45) Date of Patent: Oct. 16, 2007

(54) METHOD OF MANUFACTURING AUXILIARY MIRROR, METHOD OF MANUFACTURING LIGHT SOURCE LAMP, PROJECTOR, AND METHOD OF MANUFACTURING HOLE OPENING PARTS

(75) Inventor: Yuji Takado, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 396 days.

(21) Appl. No.: 10/957,632

(22) Filed: Oct. 5, 2004

(65) Prior Publication Data

US 2005/0259338 A1 Nov. 24, 2005

(30) Foreign Application Priority Data

May 18, 2004 (JP) ..... 2004-147682

(51) Int. Cl.
*B24B 1/00* (2006.01)

(52) U.S. Cl. ..... 451/57; 451/28; 451/51

(58) Field of Classification Search ..... 451/41, 451/46, 27, 28, 51, 57, 58, 61, 62
See application file for complete search history.

(56) References Cited

U.S. PATENT DOCUMENTS 2,583,726 A * 1/1952 Chalom ..... 451/36
6,491,396 B2 * 12/2002 Karasawa et al. ..... 353/20

FOREIGN PATENT DOCUMENTS

| | | |
|---|---|---|
| JP | A 01-293313 | 11/1989 |
| JP | U 06-015001 | 2/1994 |
| JP | A 9-120067 | 5/1997 |

* cited by examiner

*Primary Examiner*—Dung Van Nguyen
(74) *Attorney, Agent, or Firm*—Oliff & Berridge, PLC

(57) ABSTRACT

Aspects of the invention can provide a manufacturing method of a sub-mirror that can readily enhance manufacturing yield. The manufacturing method of a sub-mirror used for a light source lamp provided with an arc tube, an ellipsoidal reflector to reflect lights emitted from the arc tube to be emitted toward an illuminated region, and a sub-mirror having a reflection concave surface to reflect the lights emitted from the arc tube to the ellipsoidal reflector and a through-hole used for attachment to the arc tube. The manufacturing method of a sub-mirror can include a tube-like member preparing step of preparing a tube-like member having an inside diameter dimension matching with an inside diameter dimension of the through-hole, a grinding step of forming a concave surface, though grinding applied from one end face side of the tube-like member, a polishing step of polishing the concave surface formed in the grinding step, and a reflection layer forming step of forming the reflection concave surface by forming a reflection layer within a concave surface polished in the polishing step.

20 Claims, 9 Drawing Sheets

(a)

(b)

(c)

(a)

(b)

(c)

METHOD OF MANUFACTURING AUXILIARY MIRROR, METHOD OF MANUFACTURING LIGHT SOURCE LAMP, PROJECTOR, AND METHOD OF MANUFACTURING HOLE OPENING PARTS

BACKGROUND

Aspects of the invention can relate to a manufacturing method of a sub-mirror, a manufacturing method of a light source lamp, a projector, and a manufacturing method of a piercing part.

In a related art light source lamp used in a projector, a light source lamp provided with a sub-mirror to reflect lights, emitted from an arc tube toward an illuminated region, to a reflector. By using this light source lamp, it is possible to effectively use lights that are emitted from the arc tube toward the illuminated region to be otherwise used ineffectively. Luminance of the projector, therefore, can be improved further, see, for example, JP-A-8-31382 (FIG. 1 and FIG. 3) and JP-A-11-143378 (FIG. 1 and FIG. 2).

FIG. 9 is a view showing the structure of a related art light source lamp disclosed in JP-A-8-31382 (FIG. 1 and FIG. 3). FIG. 10 is a view showing the structure of a light source lamp disclosed in JP-A-11-143378 (FIG. 1 and FIG. 2). With the light source lamp 810/910, lights emitted from an arc tube 812/912 toward an illuminated region are reflected on a sub-mirror 813/913 to a reflector, and can be thereby used effectively.

Incidentally, it is preferable that the sub-mirror is made of a high heat resistant material, because an output from the arc tube is increased as luminance of the projector becomes higher. It is also preferable that the sub-mirror is made of a material transmitting UV lights and infrared lights that are not needed for illumination in controlling a rise in temperature in the vicinity of the arc tube by improving efficiency of heat dissipation of illumination lights. To this end, materials, for example, vitreous silica, light-transmissive alumina, sapphire, ruby, and the like, may be used as the material of such a sub-mirror.

SUMMARY

The above materials, however, can be so brittle that chipping occurs in a piercing step of making a through-hole when a sub-mirror is manufactured from these materials, which raises a problem that manufacturing yield is not readily enhanced.

The invention was devised to solve the problems discussed above, and therefore has an object to provide a manufacturing method of a sub-mirror that can readily enhance manufacturing yield. Another object can be to provide a manufacturing method of a light source lamp that can readily enhance manufacturing yield. A further object can be to provide a projector equipped with a light source lamp manufactured by such an excellent manufacturing method. The invention has still another object to provide a manufacturing method of a piercing part that can readily enhance manufacturing yield.

An exemplary manufacturing method of a sub-mirror of the invention is a manufacturing method of a sub-mirror used for a light source lamp provided with an arc tube, a reflector to reflect lights emitted from the arc tube to be emitted toward an illuminated region, and a sub-mirror having a reflection concave surface to reflect the lights emitted from the arc tube to the reflector and a through-hole used for attachment to the arc tube. The method can include a tube-like member preparing step of preparing a tube-like member having an inside diameter dimension matching with an inside diameter dimension of the through-hole, a grinding step of forming a concave surface through grinding applied from one end face side of the tube-like member, a polishing step of polishing the concave surface formed in the grinding step, and a reflection layer forming step of forming the reflection concave surface by forming a reflection layer within the concave surface polished in the polishing step.

Hence, in the exemplary manufacturing method of a sub-mirror of the invention, the tube-like member having the inside diameter dimension matching with the inside diameter dimension of the through-hole has been previously prepared in the tube-like member preparing step, and the sub-mirror can be thus manufactured using the tube-like member as a starting material. This can eliminate the need for a piercing step itself that makes it difficult to enhance manufacturing yield due to the occurrence of chipping. Manufacturing yield, therefore, will not be reduced due to the occurrence of chipping, which can in turn make it easier to enhance manufacturing yield of sub-mirrors.

For the manufacturing method of a sub-mirror of the invention, it is preferable that the tube-like member has an outside diameter dimension and a length dimension matching with an outside shape of the sub-mirror. By adopting this method, it is possible to reduce a portion that needs grinding in the grinding step as small as possible. The manufacturing time and the manufacturing costs can be thus saved as much as possible.

Also, for the manufacturing method of a sub-mirror of the invention, it is preferable that, in the grinding step, a convex surface is formed through grinding applied also from another end face side of the tube-like member. By adopting this method, the thickness of the sub-mirror can be thinner. It is thus possible to reduce a ratio of lights that are emitted from the arc tube, reflected on the reflector, and kicked out at the outer periphery of the sub-mirror. Degradation in image quality, occurring when efficiency of light utilization is reduced or the level of stray lights is raised, can be thus controlled effectively. Also, by adopting this method, the thickness of the sub-mirror can be thinner, and a rise in temperature due to absorption of infrared rays can be controlled. In this case, there can be also achieved an advantage that breaking or cracking caused due to inhomogeneous temperature distributions of the sub-mirror associated with such a rise in temperature can be controlled.

Also, for the manufacturing method of a sub-mirror of the invention, it is preferable that, in the grinding step, the concave surface and the convex surface are formed through grinding in such a manner that a length dimension along a first direction parallel to a central axis of the through-hole in an innermost peripheral surface of the tube-like member is longer than a length dimension along the first direction in an outermost peripheral surface of the tube-like member. By adopting this method, because the length dimension along the first direction in the innermost peripheral surface of the tube-like member becomes relatively long, it is possible to increase a contact area between the sub-mirror and the arc tube when the sub-mirror is attached to the arc tube. This, as a result, enables the sub-mirror to be attached more securely to the arc tube.

In addition, in the case of manufacturing the sub-mirror of a shape provided with a through-hole having a longer length dimension as described above, a hole needs to be made in a member by grinding over a relatively long distance by the manufacturing method of a sub-mirror in the related art, and chipping occurs noticeably in the piercing step. In contrast, the manufacturing method of a sub-mirror of the invention can eliminate the need of the piercing step itself, and is thereby able to avoid the occurrence of chipping. Hence, by applying the manufacturing method of a sub-mirror of the invention when manufacturing a sub-mirror provided with a through-hole having a longer length dimension, not only can manufacture yield of sub-mirrors be enhanced more readily, but also an excellent sub-mirror having the advantages described above can be manufactured more readily.

Also, for the manufacturing method of a sub-mirror of the invention, it is preferable that an inner surface of the tube-like member is a smooth surface. By adopting this method, the attachment accuracy of the sub-mirror to the arc tube can be improved.

Also, for the manufacturing method of a sub-mirror of the invention, it is preferable to further include a step of roughening an inner surface of the tube-like member. By adopting this method, when the sub-mirror is attached to the arc tube by filling the through-hole with the bonding agent, a bonding strength of the bonding agent to the sub-mirror can be increased by the anchor effect, which can in turn increase the bonding strength of the sub-mirror to the arc tube.

Also, for the manufacturing method of a sub-mirror of the invention, it is preferable that the reflection layer is formed while an inner surface of the tube-like member is covered with a mask. By adopting this method, the reflection layer forming material will not adhere to the inner surface of the tube-like member. This makes it possible to control variances in bonding conditions, caused by adhesion of the reflection layer forming material, when the sub-mirror is attached to the arc tube.

Alternatively, in the manufacturing method of a sub-mirror of the invention, the reflection layer may be formed while an inner surface of the tube-like member is exposed.

For the manufacturing method of a sub-mirror of the invention, it is preferable that the tube-like member is made of an inorganic material that transmits infrared rays. By adopting this method, because infrared rays emitted from the arc tube while the arc tube stays ON pass through the sub-mirror, it is possible to control a rise in temperature of the sub-mirror. As the inorganic material that transmits infrared rays, vitreous silica, light-transmissive alumina, sapphire, and ruby can be used suitably.

Also, for the manufacturing method of a sub-mirror of the invention, it is preferable that the reflection layer is made of a dielectric multi-layer film that transmits infrared rays. By adopting this method, because infrared rays emitted from the arc tube while the arc tube stays ON pass through the reflection layer on the sub-mirror, it is possible to control a rise in temperature of the sub-mirror effectively.

An exemplary manufacturing method of a light source lamp of the invention is a manufacturing method of a light source lamp provided with an arc tube, a reflector to reflect lights emitted from the arc tube to be emitted toward an illuminated region, and a sub-mirror having a reflection concave surface to reflect the lights emitted from the arc tube to the reflector and a through-hole used for attachment to the arc tube. The method can include a step of manufacturing a sub-mirror by the manufacturing method of a sub-mirror of the invention, and a step of attaching the sub-mirror to the arc tube.

The manufacturing method of a light source lamp of the invention is thus able to manufacture the light source lamp using the sub-mirror that is manufactured by the manufacturing method in which manufacturing yield will not be reduced due to the occurrence of chipping. This can in turn enhance manufacturing yield when light source lamps are manufactured.

An exemplary projector of the invention can include an illumination device having the light source lamp manufactured by the manufacturing method of a light source lamp of the invention, an electro-optic modulation device to modulate illumination lights from the illumination device according to image information, and a projection lens to project modulated lights from the electro-optic modulation device. Hence, the projector of the invention, by including the light source lamp manufactured by the manufacturing method that can readily enhance manufacturing yield, serves as a projector for which manufacturing costs can be readily reduced.

an exemplary manufacturing method of a piercing part of the invention is a manufacturing method of a piercing part having a concave surface or a convex surface of a plano-circular shape formed on at least one end face, and a through-hole having a central axis that agrees with a central axis of the concave surface or the convex surface. The method can include a tube-like member preparing step of preparing a tube-like member having an inside diameter dimension matching with an inside diameter dimension of the through-hole, and a grinding step of forming the concave surface or the convex surface through grinding applied from one end face side of the tube-like member.

Hence, in the manufacturing method of a piercing part of the invention, the tube-like member having the inside diameter dimension matching with the inside diameter dimension of the through-hole has been previously prepared in the tube-like member preparing step, and the piercing part can be thus manufactured using the tube-like member as a starting material. This eliminates the need for a piercing step itself that makes it difficult to enhance manufacturing yield due to the occurrence of chipping. Manufacturing yield, therefore, will not be reduced due to the occurrence of chipping, which can in turn make it easier to enhance manufacturing yield of piercing parts.

Also, in the manufacturing method of a piercing part of the invention, the concave surface or the convex surface formed through grinding can be of either a spherical shape or an aspherical shape.

BRIEF DESCRIPTION OF THE DRAWINGS

The invention will be described with reference to the accompanying drawings, wherein like numerals reference like elements, and wherein.

DETAILED DESCRIPTION OF PREFERRED EMBODIMENTS

Figure 1:
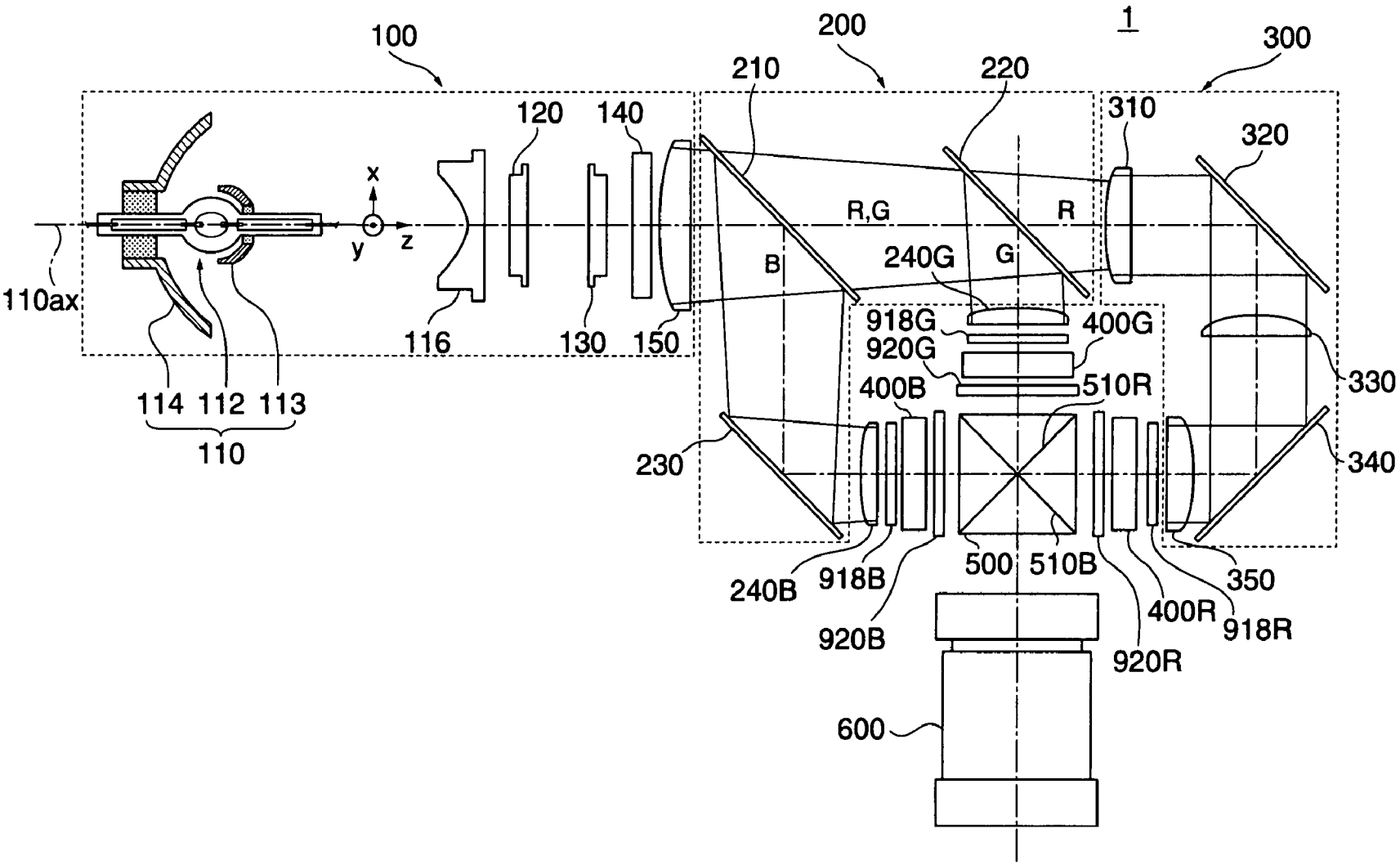
FIG. 1 is a plan view showing optical systems in a projector according to an exemplary embodiment.

A manufacturing method of a sub-mirror, a manufacturing method of a light source lamp, and a projector of the invention will now be described by way of embodiments shown in the drawings.

A projector according to a first exemplary embodiment will be described first with reference to FIG. 1. FIG. 1 is a plan view showing optical systems in the projector according to the first exemplary embodiment. Hereinafter, three directions intersecting with each other at right angles are referred to as the z direction (a direction in the light-source optical axis in FIG. 1), the x direction (a direction parallel to the sheet surface and intersecting with the z axis at right angles in FIG. 1), and the y direction (a direction perpendicular to the sheet surface and intersecting with the z axis at right angles in FIG. 1).

As is shown in FIG. 1, a projector 1 according to the first exemplary embodiment can include an illumination device 100, a color separation system 200, a relay system 300, three liquid crystal devices 400R, 400G, and 400B, a cross dichroic prism 500, and a projection system 600. The components forming the optical systems are disposed in substantially the horizontal direction about the cross dichroic prism 500.

The illumination device 100 can include a light source lamp 110, a parallelizing lens 116, a first lens array 120, a second lens array 130, a polarization conversion element 140, and a superimposing lens 150. Lights emitted from the light source lamp 110 are changed to substantially parallel lights by the parallelizing lens 116, after which respective lights are divided into plural partial lights by the first lens array 120. Respective partial lights are then superimposed on image forming regions in the three liquid crystal devices 400R, 400G, and 400B, which are the subjects to be illuminated, by the second lens array 130 and the superimposing lens 150.

The light source lamp 110 can include an arc tube 112, an ellipsoidal reflector 114, and a sub-mirror 113. The arc tube 112 is disposed in such a manner that its luminescent center is on one focal point of the ellipsoidal reflector 114. The ellipsoidal reflector 114 opens toward an illuminated region, and is disposed behind the arc portion of the arc tube 112. It is configured to reflect lights emitted from the arc tube 112 to be emitted toward the illuminated region.

The sub-mirror 113 is configured to reflect lights emitted from the arc tube 112 to the ellipsoidal reflector 114.

The light source lamp 110 will be described in detail below.

The parallelizing lens 116 can include a concave lens having a lens optical axis parallel to the light-source optical axis 110*ax*, and is disposed on the illuminated region side of the light source lamp 110. It is configured to make reflection lights from the ellipsoidal reflector 114 parallel.

The first lens array 120 and the second lens array 130 are formed by aligning small lenses in a matrix fashion. The polarization conversion element 140 is furnished with a function of converting unpolarized light into polarized light having polarization directions usable in the three liquid crystal devices 400R, 400G, and 400B.

The color separation system 200 is furnished with a function of separating illumination lights emitted from the illumination device 100 into illumination lights of three colors each having a different wave range. A first dichroic mirror 210 reflects substantially blue light (hereinafter, referred to as B light) and transmits substantially green light (hereinafter, referred to as G light) and substantially red light (hereinafter, referred to as R light). B light reflected on the first dichroic mirror 210 are further reflected on a reflection mirror 230 and pass through a field lens 240B to illuminate the liquid crystal device 400B for B light.

The field lens 240B collects lights for all the plural partial lights from the illumination device 100 to illuminate the liquid crystal device 400B. Normally, it is set so that respective partial lights are changed independently to substantially parallel lights. Field lenses 240G and 350 provided in front of the other liquid crystal devices 400G and 400R, respectively, are configured in the same manner as the field lens 240B.

Of the G light and R light having passed through the first dichroic mirror 210, G light is reflected on a second dichroic mirror 220, and passes through the field lens 240G to illuminate the liquid crystal device 400G for G light. Meanwhile, R light passes through the second dichroic mirror 220 and illuminate the liquid crystal device 400R for R light by passing through the relay system 300.

The relay system 300 can include a light incident-side lens 310, a light incident-side reflection mirror 320, a relay lens 330, a light exiting-side reflection mirror 340, and the field lens 350. The R light emitted from the color separation system 200 can be converged in close proximity to the relay lens 330 by the light incident-side lens 310, and can be diffused toward the light exiting-side reflection mirror 340 and the field lens 350. The size of lights that go incident on the field lens 350 is set to be nearly equal to the size of lights that go incident on the light incident-side lens 310.

The liquid crystal devices 400R, 400G, and 400B of respective color lights convert color lights that come incident on their light incident surfaces into lights according to corresponding image signals, and emit the lights thus converted as transmitting lights. On the light incident-sides of the liquid crystal devices 400R, 400G, and 400B are disposed light incident-side polarizers 918R, 918G, and 918B, respectively, and light exiting-side polarizers 920R, 920G, and 920B are disposed on the light exiting-sides. Transmission type liquid crystal panels are used as the liquid crystal devices 400R, 400G, and 400B.

The cross dichroic prism 500 can be furnished with a function to serve as a color combining system to combine converted lights of respective colors emitted from the liquid crystal devices 400R, 400G, and 400B for respective color lights. It includes an R-light reflection dichroic surface 510R to reflect R lights, and a B-light reflection dichroic surface 510B to reflect B lights. The R-light reflection dichroic surface 510R and the B-light reflection dichroic surface 510B are provided by forming a dielectric multi-layer film to reflect R lights and a dielectric multi-layer film to reflect B lights on the interfaces of four rectangular prisms almost in the shape of a capital X. Converted lights of three colors are combined by both the reflection dichroic surfaces 510R and 510B, and lights to display color images are thus generated. The combined lights generated in the cross dichroic prism 500 are emitted toward the projection system 600.

The projection system 600 is configured to project combined lights from the cross dichroic prism 500 onto a projection surface, such as a screen, in the form of display images.

Figure 2:
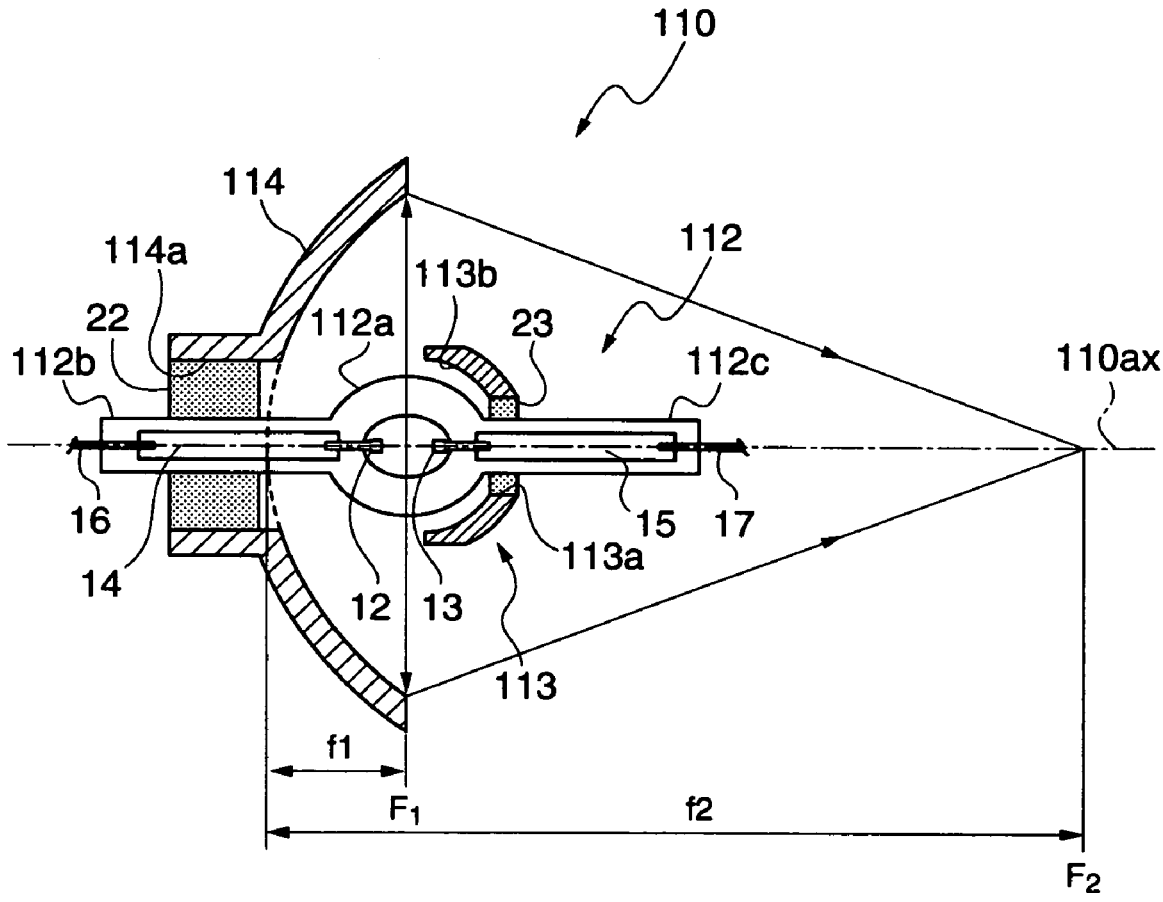
FIG. 2 is a cross section showing a light source lamp in a first exemplary embodiment.
Figure 3:
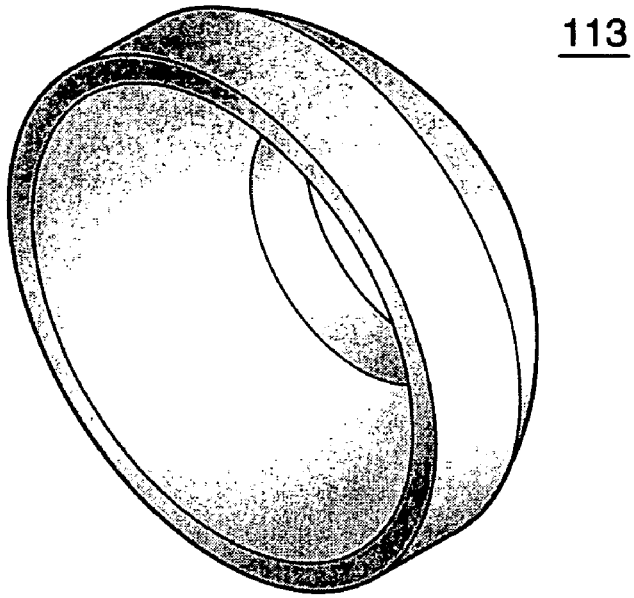
FIG. 3 is a view showing a sub-mirror of the light source lamp in the first exemplary embodiment.
Figure 3:
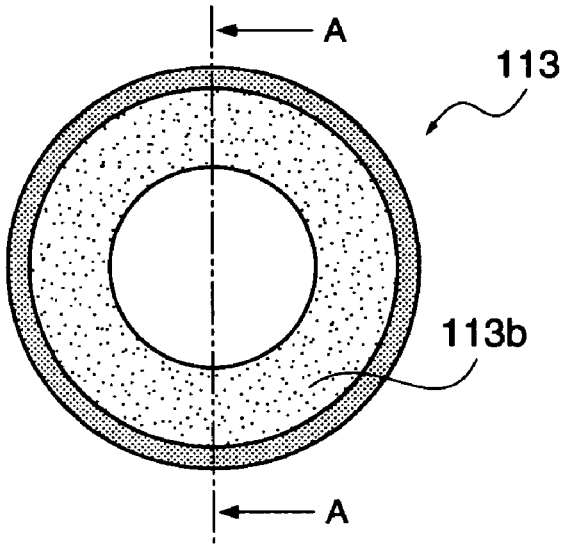
Figure 3:
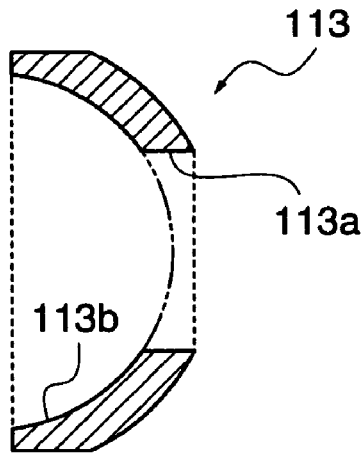

The light source lamp 110 will now be described in detail with reference to FIG. 2 and FIG. 3. FIG. 2 is a cross section showing the light source lamp in the first exemplary embodiment, and FIG. 3 is a view showing the sub-mirror of the light source lamp in the first exemplary embodiment. FIG. 3(*a*) is a perspective view, FIG. 3(*b*) is a front view, and FIG. 3(*c*) is a cross section taken along the line A-A of FIG. 3(*b*).

As is shown in FIG. 2, the light source lamp 110 includes the arc tube 112, the ellipsoidal reflector 114, and the sub-mirror 113.

The arc tube 112 is made of, for example, vitreous silica, and includes an arc portion 112*a* enclosing electrodes 12 and 13 made of tungsten, and sealing portions 112*b* and 112*c* that come in contact continuously with the both sides of the arc portion 112*a*. The arc portion 112*a* is hollow, inside of which are sealed mercury, an inert gas, and halogen. The arc portion 112*a* is disposed in close proximity to the position of a focal point $F_1$, which is one of two focal points $F_1$ and $F_2$ of the ellipsoidal reflector 114. In the sealing portions 112*b* and 112*c* are hermetically sealed metal foils 14 and 15, respectively, which are connected to the electrodes 12 and 13, respectively. Leads 16 and 17 for external connections are connected to the metal foils 14 and 15, respectively.

The ellipsoidal reflector 114 has two focal points $F_1$ and $F_2$ disposed on the light-source optical axis 110*ax* at a specific interval. These focal points $F_1$ and $F_2$ are disposed at positions spaced apart by optical distances $f_1$ and $f_2$, respectively, from a virtual point O at which a virtual ellipsoid that continues with the ellipsoid of the ellipsoidal reflector 114 intersects with the light-source optical axis 110*ax*. The ellipsoidal reflector 114 is provided with a through-hole 114*a* through which the arc tube 112 (sealing portion 112*b*) is inserted to be fixed. The through-hole 114*a* is disposed along the light-source optical axis 110*ax*. The sealing portion 112*b* of the arc tube 112 is fixed inside the through-hole 114*a* by an inorganic bonding agent 22, such as cement.

The sub-mirror 113 is disposed on the illuminated region side of the arc portion 112*a*. As are shown in FIG. 3(*a*) through FIG. 3(*c*), the sub-mirror 113 can include a reflection concave surface 113*b* to reflect lights emitted from the arc tube 112 to the ellipsoidal reflector 114 and a through-hole 113*a* used for attachment to the arc tube 112. The central axis of the through-hole 113*a* in the sub-mirror 113 is disposed to agree or almost agree with the light-source optical axis 110*ax*. The sealing portion 112*b* of the arc tube 112 is fixed inside the through-hole 113*a* by an inorganic bonding agent 23, such as cement.

Inorganic materials that transmit infrared rays, such as vitreous silica, light-transmissive alumina, sapphire, and ruby, can be used as materials of the sub-mirror 113.

A reflection layer can be provided on the surface of the reflection concave surface 113*b* of the sub-mirror 113. It is preferable to use a dielectric multi-layer film having characteristics to transmit infrared rays as this reflection layer. By using a dielectric multi-layer film having characteristics to transmit infrared rays as the reflection layer, and by using the foregoing inorganic materials that transmit infrared rays as the material of the sub-mirror 113, infrared rays emitted from the arc tube 112 pass through the reflection layer without being reflected thereon, and these infrared rays further pass through the sub-mirror 113, which makes it possible to control a rise in temperature in the vicinity of the sub-mirror 113 and the arc tube 112. An example of the dielectric multi-layer film forming the reflection layer includes a $Ta_2O_5$ film and a $SiO_2$ film laminated alternately.

Figure 4:
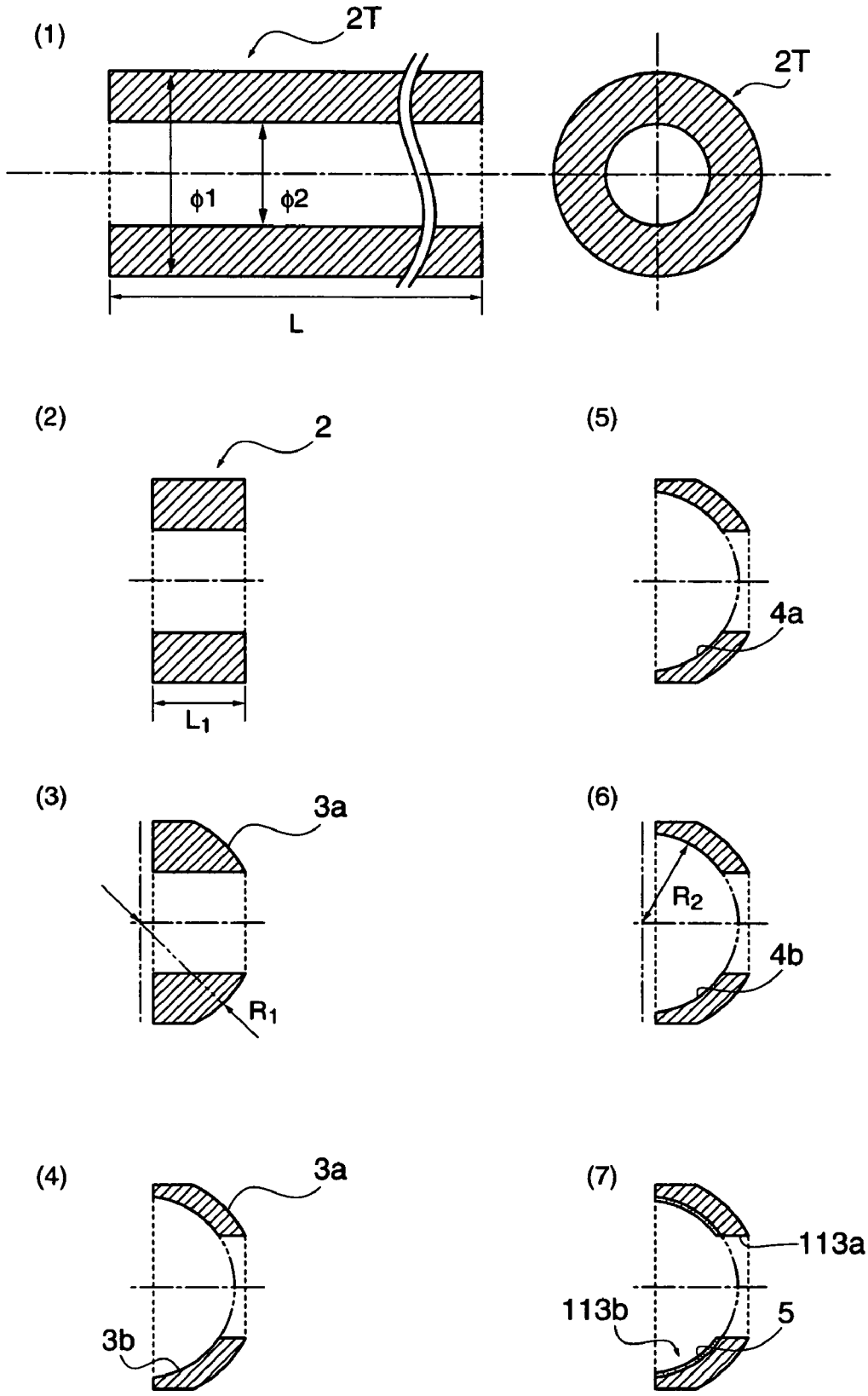
FIG. 4 is a view used to describe a manufacturing method of a sub-mirror according to the first exemplary embodiment.

A manufacturing method of a sub-mirror according to the first exemplary embodiment will now be described with reference to FIG. 4. FIG. 4 is a view used to describe the manufacturing method of a sub-mirror according to the first embodiment. FIG. 4(1) and FIG. 4(2) are, respectively, a side view and a cross section used to describe a tube-like member preparing step. FIG. 4(3) and FIG. 4(4) are side views used to describe a grinding step. FIG. 4(5) and FIG. 4(6) are side views used to describe a polishing step. FIG. 4(7) is a side view used to describe a reflection layer forming step.

In the manufacturing method of a sub-mirror according to the first exemplary embodiment, because the tube-like member preparing step, the grinding step, the polishing step, and the reflection layer forming step are performed sequentially, the respective steps will be described sequentially.

It should be noted that the shape of the sub-mirror has been previously determined through computer simulations in enabling its function to be fully exerted.

1. Tube-Like Member Preparing Step

Initially, as is shown in FIG. 4(1), a vitreous silica tube 2T is prepared, which has an outside diameter dimension ($\phi_1$=14±0.1 mm) matching with the outside shape of the sub-mirror 113 and an inside diameter dimension ($\phi_2$=6.8±0.3 mm) matching with the inside diameter dimension of the through-hole 113*a*. A length dimension L in a direction along the central axis of the vitreous silica tube 2T is, for example, 200 mm.

Then, a tube-like member 2 having a length dimension $L_1$ matching with the outside shape of the sub-mirror 113 is formed by cutting the vitreous silica tube 2T along a virtual plane perpendicular to the central axis of the vitreous silica tube 2T as is shown in FIG. 4(2), for example, with the use of a wire saw. The length dimension $L_1$ in the direction along the central axis of the tube-like member 2 is, for example, 6.3 mm.

In the manufacturing method of a sub-mirror according to the first embodiment, the inner surface of the tube-like member 2 (vitreous silica glass 2T) is a smooth surface. This configuration makes it possible to improve the attachment accuracy of the sub-mirror 113 to the arc tube 112.

2. Grinding Step

Subsequently, in addition to a concave surface 3*b* formed through grinding applied from one end face side (on the left of FIG. 4(4)), a convex surface 3*a* is formed through grinding applied from the other end face side (on the right of FIG. 4(3)) of the tube-like member 2, as is shown in FIG. 4(3), for example, with the use of a curve generator. A radius of curvature, $R_1$, of the convex surface 3*a* is, for example, 7.8 mm.

The order as to which of the grinding to form the convex surface 3*a* or the grinding to form the concave surface 3*b* comes first is not especially limited. In other words, as in the manufacturing method of a sub-mirror according to the first embodiment, the concave surface 3*b* may be formed after the convex surface 3*a* is formed, or alternatively, the convex surface may be formed after the concave surface is formed.

In addition, in the manufacturing method of a sub-mirror according to the first exemplary embodiment, the concave surface 3*b* or the convex surface 3*a* formed through grinding are of a generally spherical shape, however, they may be of an aspherical shape.

3. Polishing Step

Subsequently, a concave surface 4*a* as is shown in FIG. 4(5) is formed through semi-finishing by polishing the concave surface 3*b* formed in the grinding step, for example, with the use of a lens polishing machine. Then, a concave surface 4*b* as is shown in FIG. 4(6) is formed through mirroring by further polishing the concave surface 4*a*. A radius of curvature, $R_2$, of the convex surface 4*b* is, for example, 6.3 mm.

As with the concave surface 3*b*, the concave surface 4*b* may be of an aspherical shape.

4. Reflection Layer Forming Step

Subsequently, a reflection concave surface 113*b* is formed as is shown in FIG. 4(7) by forming a reflection layer 5 within the concave surface 4*b* polished in the polishing step, for example, with the use of an ion-assisted evaporator. The reflection layer 5 is a dielectric multi-layer film formed by laminating a $Ta_2O_5$ film and a $SiO_2$ film alternately by evaporation.

As has been described, the manufacturing method of a sub-mirror according to the first exemplary embodiment can include the tube-like member preparing step of preparing the tube-like member 2 (vitreous silica tube 2T) having the inside diameter dimension matching with the inside diameter dimension of the through-hole 113*a*, the grinding step of forming the concave surface 3*b* through grinding applied from one end face side of the tube-like member 2, the polishing step of polishing the concave surface 3*b* formed in the grinding step, and the reflection layer forming step of forming the reflection concave surface 113*b* by forming the reflection layer within the concave surface 4*b* polished in the polishing step.

Hence, in the manufacturing method of a sub-mirror according to the first exemplary embodiment, the tube-like member 2 (vitreous silica tube 2T) having the inside diameter dimension matching with the inside diameter dimension of the through-hole 113*a* has been previously prepared in the tube-like member preparing step, and the sub-mirror 113 can be thus manufactured using the tube-like member 2 (vitreous silica tube 2T) as a starting material. This eliminates the need for a piercing step itself that makes it difficult to enhance manufacturing yield due to the occurrence of chipping. Manufacturing yield, therefore, will not be reduced due to the occurrence of chipping, which can in turn make it easier to enhance manufacturing yield of sub-mirrors.

In addition, in the manufacturing method of a sub-mirror according to the first exemplary embodiment, the tube-like member 2 has the outside diameter dimension and the length dimension matching with the outside shape of the sub-mirror 113. By adopting this method, it is possible to reduce a portion that needs grinding in the grinding step as small as possible. The manufacturing time and the manufacturing costs can be thus saved as much as possible.

In the manufacturing method of a sub-mirror according to the first embodiment, the convex surface 3*a* is formed through grinding applied also from the other end face side of the tube-like member 2 in the grinding step. By adopting this method, the thickness of the sub-mirror 113 can be thinner. It is thus possible to reduce a ratio of lights that are emitted from the arc tube 112, reflected on the ellipsoidal reflector 114, and kicked out at the outer periphery of the sub-mirror 113. Degradation in image quality, occurring when efficiency of light utilization is reduced or the level of stray lights is raised, can be thus controlled effectively. Also, by adopting this method, the thickness of the sub-mirror 113 can be thinner, and a rise in temperature due to absorption of infrared rays can be controlled. In this case, there can be also achieved an advantage that breaking or cracking caused due to inhomogeneous temperature distributions of the sub-mirror associated with such a rise in temperature can be controlled.

The manufacturing method of a sub-mirror according to the first embodiment may further include a step of roughening the inner surface of the tube-like member 2. By adopting this method, when the sub-mirror 113 is attached to the arc tube 112 by filling the through-hole 113*a* with the bonding agent, a bonding strength of the bonding agent to the sub-mirror 113 can be increased by the anchor effect, which can in turn increase the bonding strength of the sub-mirror 113 to the arc tube 112.

In the manufacturing method of a sub-mirror according to the first embodiment, the reflection layer 5 can be formed while the inner surface of the tube-like member 2 is covered with a mask. By adopting this method, the reflection layer forming material will not adhere to the inner surface of the tube-like member 2. This makes it possible to control variances in bonding conditions, caused by adhesion of the reflection layer forming material, when the sub-mirror 113 is attached to the arc tube 112. It should be noted, however, that the reflection layer 5 can be formed while the inner surface of the tube-like member 2 is exposed.

Figure 5:
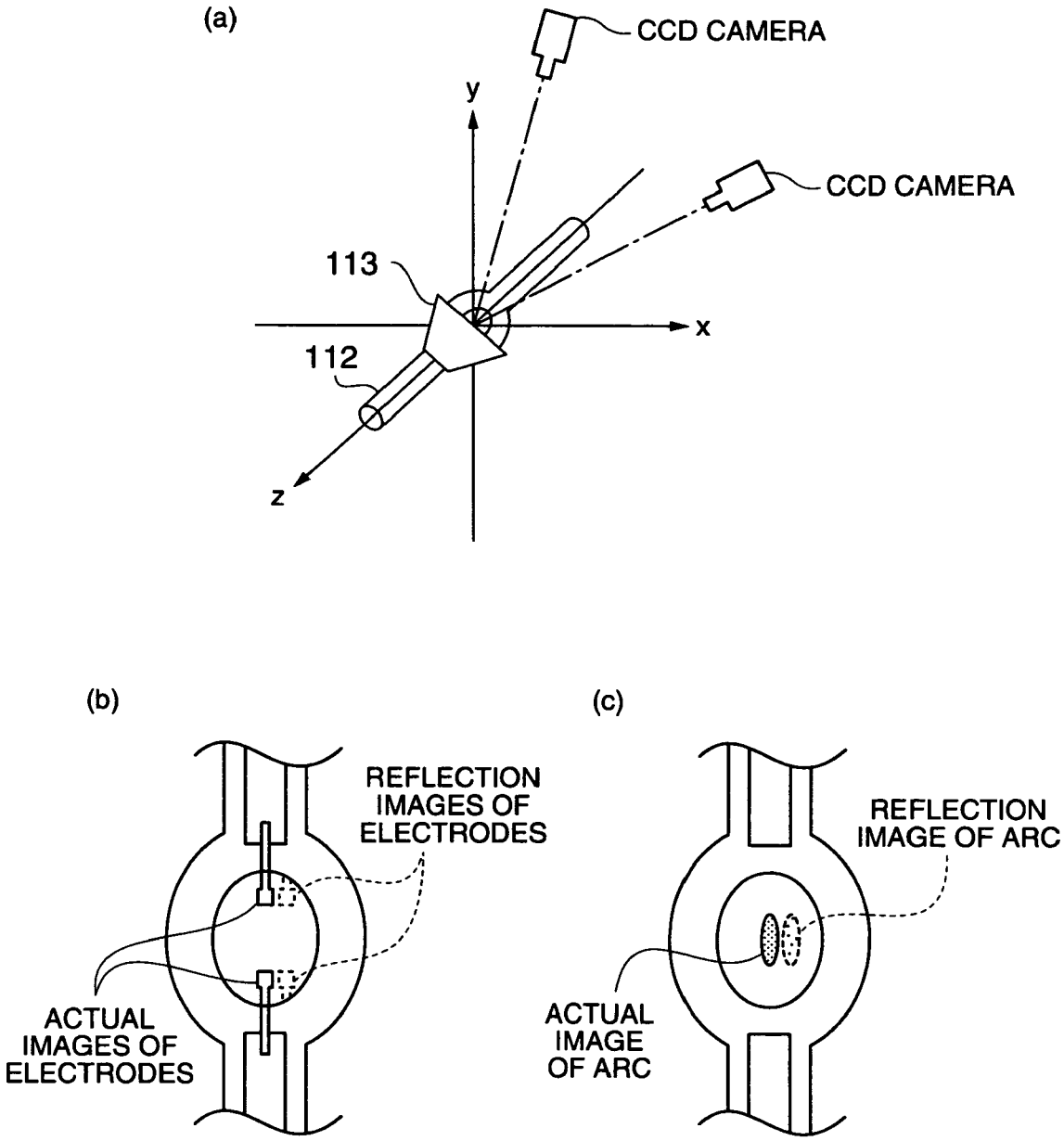
FIG. 5 is a view used to describe a manufacturing method of a light source lamp according to the first exemplary embodiment.
Figure 6:
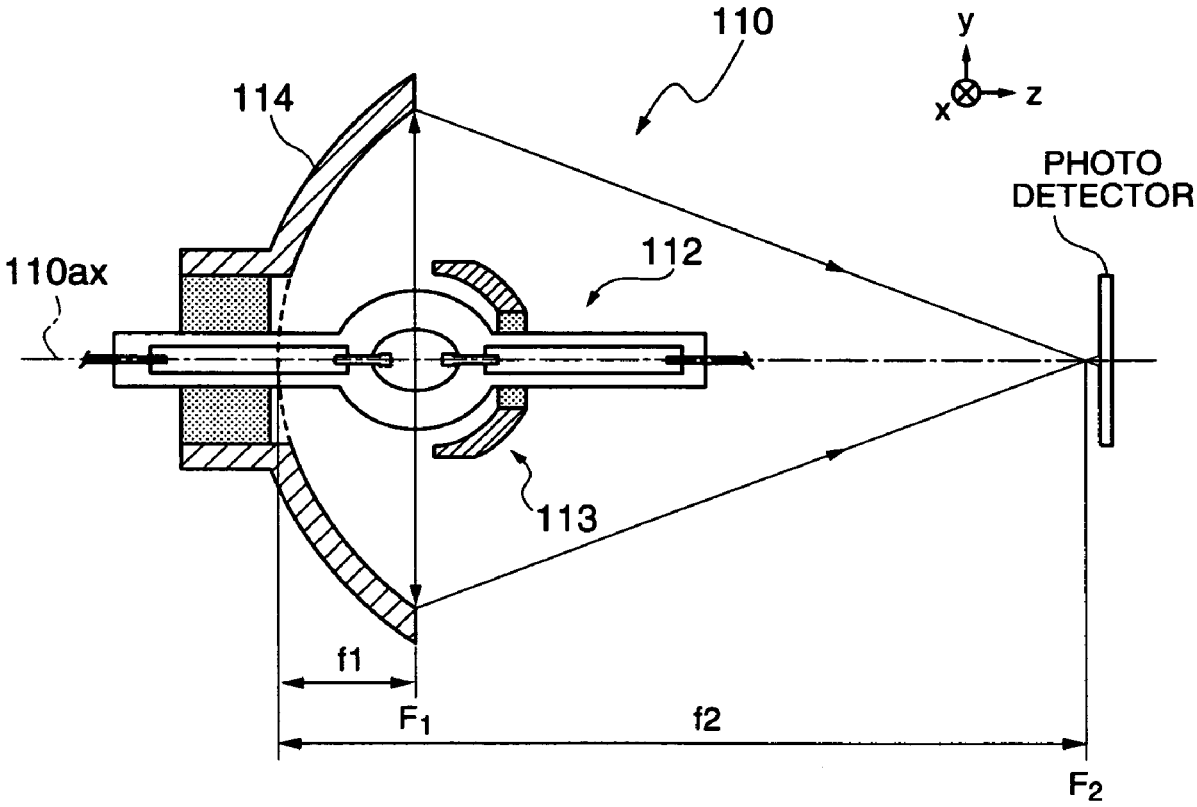
FIG. 6 is a view used to describe the manufacturing method of a light source lamp according to the first exemplary embodiment.

A manufacturing method of a light source lamp according to the first exemplary embodiment will now be described with reference to FIG. 2, FIG. 5, and FIG. 6. FIG. 5 and FIG. 6 are views used to describe the manufacturing method of a light source lamp according to the first embodiment. FIG. 5(*a*) is an image view taken by CCD cameras from two directions to adjust the position of the sub-mirror. FIG. 5(*b*) is a conceptual view when actual images and reflection images of the electrodes are superimposed. FIG. 5(*c*) is a conceptual view when an actual image and a reflection image of an arc between the electrodes while the arc tube stays ON are superimposed.

In the manufacturing method of a light source lamp according to the first embodiment, a step of attaching the sub-mirror 113 to the arc tube 112 is performed after a step of manufacturing the sub-mirror 113, and then a step of attaching the arc tube 112, to which the sub-mirror 113 has been attached, to the ellipsoidal reflector 114 is performed. Because the step of manufacturing the sub-mirror 113 is performed by the same manufacturing method as the manufacturing method of a sub-mirror according to the first embodiment described above, the description of the step of manufacturing a sub-mirror is omitted herein. Hereinafter, the step of attaching the sub-mirror 113 to the arc tube 112, and the step of attaching the arc tube 112, to which the sub-mirror 113 has been attached, to the ellipsoidal reflector 114 will be described in detail.

Initially, the sealing portion 112*c* of the arc tube 112 is inserted through the through-hole 113*a* in the sub-mirror 113. Then, the arc tube 112 and the sub-mirror 113 are fixed temporarily by adjusting the position of the sub-mirror 113 in such a manner that the actual images of the electrodes 12 and 13 or the actual image of the arc between the electrodes (during arc ON-time) of the arc tube 112 and the reflection image(s) thereof by the sub-mirror 113 are superimposed as are shown in FIG. 5(*b*) and FIG. 5(*c*). In this case, as is shown in FIG. 5(*a*), the actual image(s) and the reflection image(s) are detected at least from two directions through the use of an image taken by cameras (CCD cameras or the like). Then, the position of the sub-mirror 113 is adjusted with respect to the arc tube 112 so that the actual image(s) and the reflection image(s) are superimposed in each direction.

Subsequently, as is shown in FIG. 2, a space between the through-hole 113*a* in the sub-mirror 113 and the sealing portion 112*c* of the arc tube 112 is filled with the inorganic bonding agent 23 to fix the sub-mirror 113 to the arc tube 112.

Subsequently, the ellipsoidal reflector 114 and the arc tube 112 are disposed by bringing the focal point $F_1$ of the ellipsoidal reflector 114 into agreement with the center of the electrodes in the arc tube 112 to which the sub-mirror 113 has been fixed as described above, and the position of the arc tube 112 is adjusted with respect to the ellipsoidal reflector 114 to achieve the maximum brightness at a specific position.

Subsequently, as is shown in FIG. 2, a space between the through-hole 114*a* in the ellipsoidal reflector 114 and the sealing portion 112*b* of the arc tube 112 is filled with the inorganic bonding agent 22 to fix the arc tube 112 to the ellipsoidal reflector 114.

The light source lamp 110 can be manufactured at high accuracy in this manner.

In the manufacturing method of a light source lamp according to the first embodiment, the arc tube 112 and the ellipsoidal reflector 114 are fixed to each other, as is shown in FIG. 6, by disposing a photo detector near the design light-collecting spot, and by adjusting the relative positions of the arc tube 112 and the ellipsoidal reflector 114 independently in the x direction, the y direction, and the z direction while the reflection lights from the ellipsoidal reflector 114 are measured in the photo detector, so that the maximum brightness is achieved at the design light-collecting spot.

In the manufacturing method of a light source lamp according to the first embodiment, brightness is measured by the photo detector. However, any other method is applicable provided that illuminance can be measured. It is thus possible to manufacture the light source lamp 110 in which the relative positional relation between the arc tube 112 and the ellipsoidal reflector 114 is such that the maximum illuminance is achieved at a specific position.

Alternatively, the arc tube 112 and the ellipsoidal reflector 114 may be fixed to each other by adjusting the relative positions of the arc tube 112 and the ellipsoidal reflector 114 independently in the x direction, the y direction, and the z direction, so that maximum brightness is achieved at positions at which the liquid crystal devices 400R, 400G, and 400B, which are the subjects to be illuminated by the light source lamp 110, are disposed in the illumination device 100 in which the light source lamp 110 is mounted. It is thus possible to manufacture the illumination device 100 including the light source lamp 110 that has the optimum relative positional relation between the arc tube 112 and the ellipsoidal reflector 114, including the relation with the optical system present between the light source lamp 110 and the subjects to be illuminated.

The manufacturing method of a light source lamp according to the first embodiment as described above is thus able to manufacture the light source lamp 110 using the sub-mirror 113 that is manufactured by the manufacturing method in which manufacturing yield will not be reduced due to the occurrence of chipping. This can in turn enhance manufacturing yield when light source lamps are manufactured.

The projector 1 according to the first exemplary embodiment can include the illumination device 100 having the light source lamp 110 manufactured by the manufacturing method of a light source lamp according to the first embodiment, the liquid crystal devices 400R, 400G, and 400B to modulate illumination lights from the illumination device 100 according to image information, and the projection system 600 to project modulated lights from the liquid crystal devices 400R, 400G, and 400B. Hence, the projector, by including the light source lamp 110 manufactured by the manufacturing method that can readily enhance manufacturing yield, serves as a projector for which manufacturing costs can be readily reduced.

Figure 7:
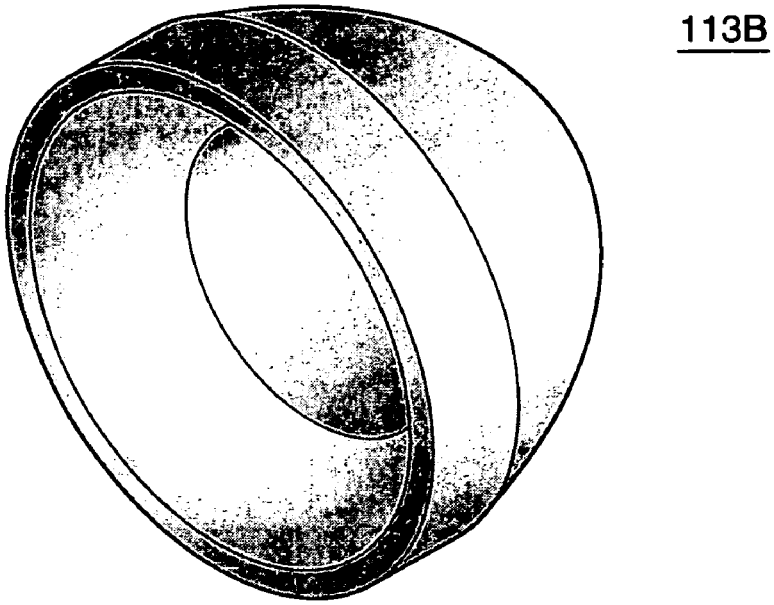
FIG. 7 is a view showing a sub-mirror of a light source lamp in a second exemplary embodiment.
Figure 7:
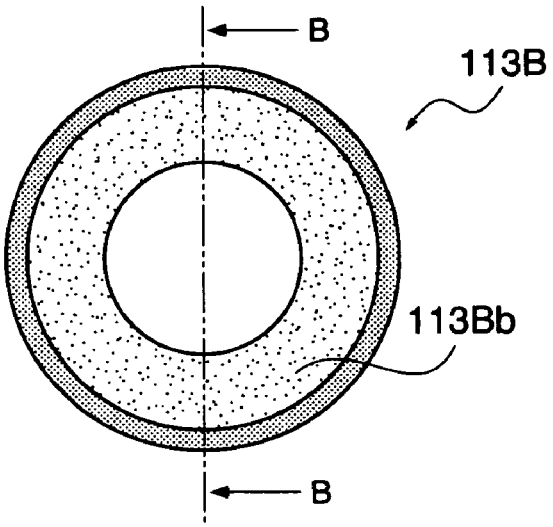
Figure 7:
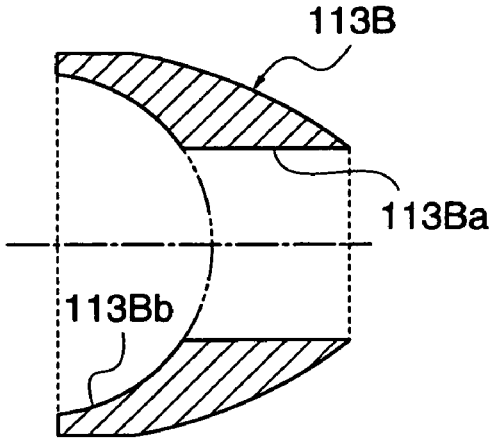
Figure 8:
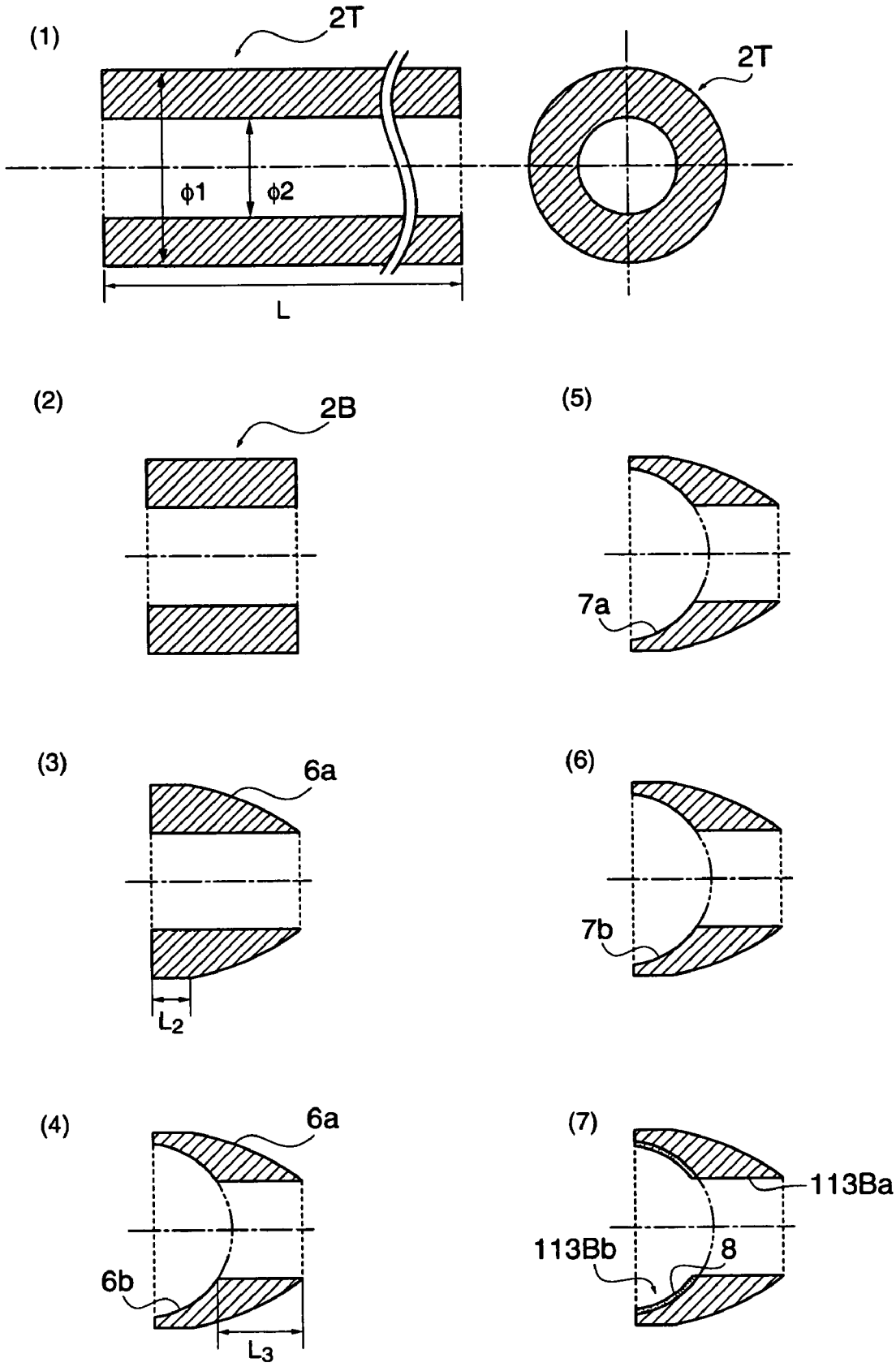
FIG. 8 is a view used to describe a manufacturing method of a sub-mirror according to the second exemplary embodiment.
Figure 9:
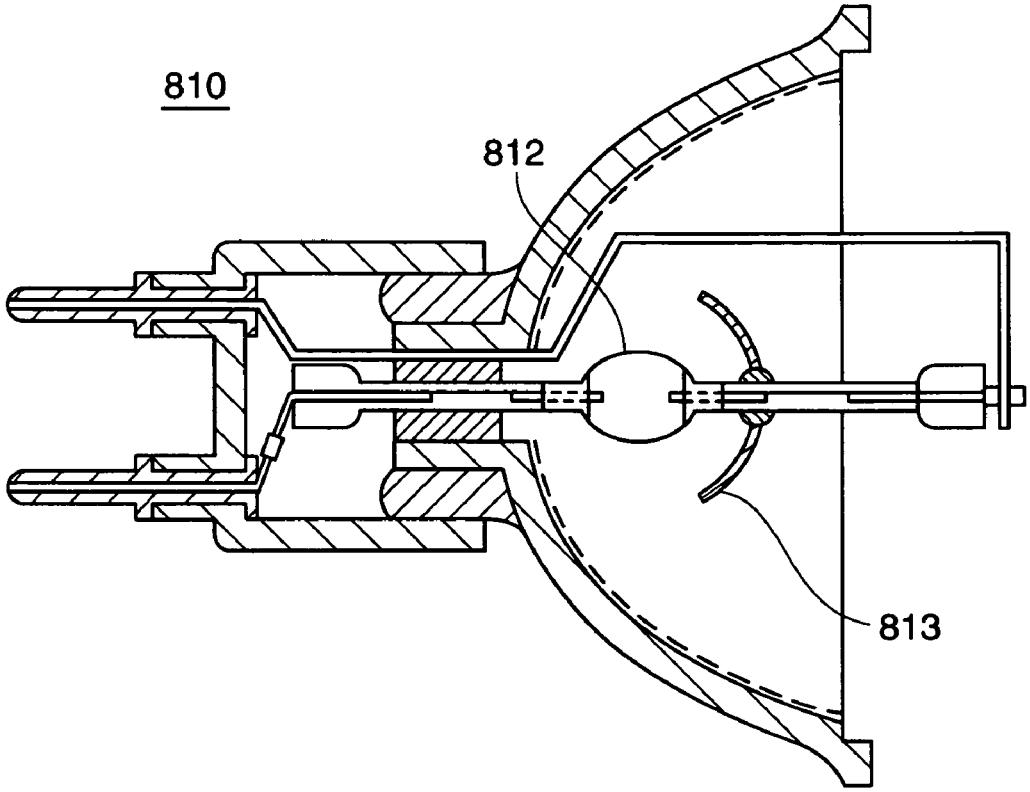
FIG. 9 is a view showing the structure of a light source lamp in the related art.
Figure 10:
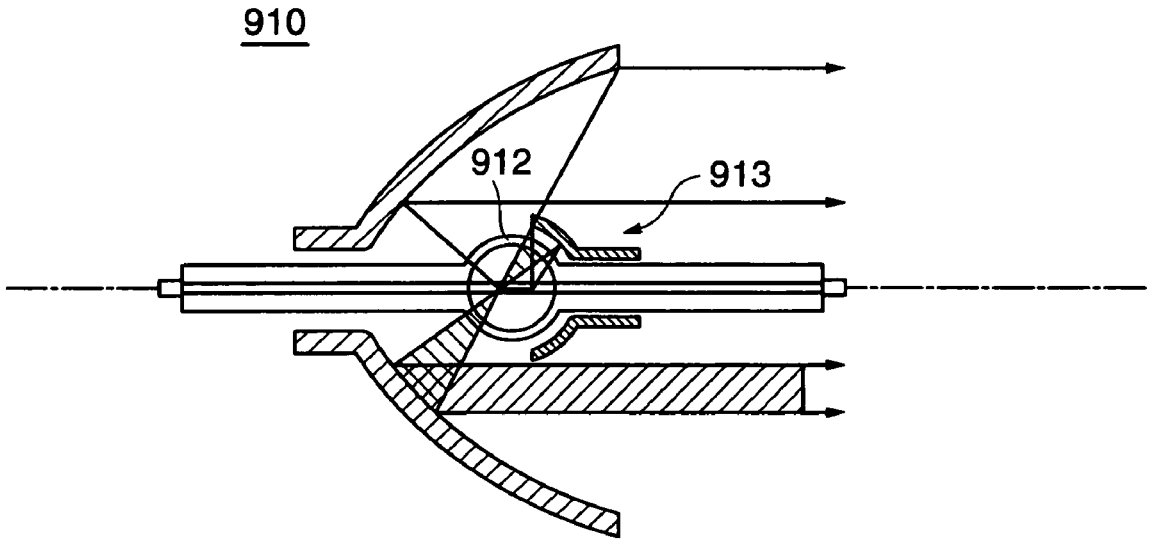
FIG. 10 is a view showing the structure of a light source lamp in the related art.

FIG. 7 is a view showing a sub-mirror of a light source lamp in a second exemplary embodiment. FIG. 7(*a*) is a perspective view, FIG. 7(*b*) is a front view, and FIG. 7(*c*) is a cross section taken along the line B-B of FIG. 7(*b*). FIG. 8 is a view used to describe a manufacturing method of a sub-mirror according to the second embodiment. FIG. 8(1) and FIG. 8(2) are, respectively, a side view and a cross section, used to describe a tube-like member preparing step. FIG. 8(3) and FIG. 8(4) are side views used to describe a grinding step. FIG. 8(5) and FIG. 8(6) are side views used to describe a polishing step. FIG. 8(7) is a side view used to describe a reflection layer forming step. In FIG. 7 and FIG. 8, like members are labeled with like reference numerals with respect to FIG. 3 and FIG. 4, and a detailed description thereof is omitted.

As shown in FIG. 7 and FIG. 8, the manufacturing method of a sub-mirror according to the second exemplary embodiment is different from the manufacturing method of a sub-mirror according to the first exemplary embodiment in that the length dimension of a through-hole 113Ba in a sub-mirror 113B produced by the corresponding manufacturing method is longer. However, other than this point, the manufacturing method of a sub-mirror according to the second exemplary embodiment has the same steps and arrangements as those of the manufacturing method of a sub-mirror according to the first exemplary embodiment, and therefore achieves exactly the same advantages as those attained by the manufacturing method of a sub-mirror according to the first exemplary embodiment.

To be more specific, the manufacturing method of a sub-mirror according to the second exemplary embodiment is a manufacturing method of a sub-mirror used for a light source lamp 110B (not shown) provided with an arc tube 112, an ellipsoidal reflector 114 to reflect lights emitted from the arc tube 112 to be emitted toward an illuminated region, and a sub-mirror 113B having a reflection concave surface 113Bb to reflect lights emitted from the arc tube 112 to the ellipsoidal reflector 114 and a through-hole 113Ba used for attachment to the arc tube 112, and includes a tube-like member preparing step (see FIG. 8(1) and FIG. 8(2)) to prepare a tube-like member 2B (vitreous silica tube 2T) having an inside diameter dimension matching with the inside diameter dimension of the through-hole 113Ba, a grinding step (see FIG. 8(3)) to form a concave surface 6*b* through grinding applied from one end face side of the tube-like member 2B, a polishing step (see FIG. 8(5) and FIG. 8(6)) to polish the concave surface 6*b* formed in the grinding step, and a reflection layer forming step (see FIG. 8(7)) to form a reflection concave surface 113Bb by forming a reflection layer within a concave surface 7*b* polished in the polishing step.

Hence, in the manufacturing method of a sub-mirror according to the second exemplary embodiment, the tube-like member 2B (vitreous silica tube 2T) having the inside diameter dimension matching with the inside diameter dimension of the through-hole 113Ba has been previously prepared in the tube-like member preparing step shown in FIG. 8(1), and the sub-mirror 113B can be thus manufactured using the tube-like member 2B (vitreous silica tube 2T) as a starting material. This eliminates the need for a piercing step itself that makes it difficult to enhance manufacturing yield due to the occurrence of chipping. Manufacturing yield, therefore, will not be reduced due to the occurrence of chipping, which can in turn make it easier to enhance manufacturing yield of sub-mirrors.

In addition, in the manufacturing method of a sub-mirror according to the second exemplary embodiment, the concave surface 6*b* and the convex surface 6*a* are formed in the grinding step shown in FIG. 8(3) and FIG. 8(4) by performing grinding in such a manner that a length dimension $L_3$ along a first direction parallel to the central axis of the through-hole in the innermost peripheral surface of the tube-like member 2B is longer than a length dimension $L_2$ along the first direction in the outermost peripheral surface of the tube-like member 2B.

By adopting this method, because the length dimension $L_3$ along the first direction in the innermost peripheral surface of the tube-like member 2B becomes relatively long, it is possible to increase a contact area between the sub-mirror 113B and the arc tube 112 when the sub-mirror 113B is attached to the arc tube 112. This, as a result, enables the sub-mirror 113B to be attached more securely to the arc tube 112.

In the case of manufacturing the sub-mirror 113B of a shape provided with the through-hole 113Ba having a longer length dimension as described above, a hole needs to be made in a member by grinding over a relatively long distance by the manufacturing method of a sub-mirror in the related art, and chipping occurs noticeably in the piercing step. In contrast, the manufacturing method of a sub-mirror according to the second exemplary embodiment can eliminate the need for the piercing step itself, and is thereby able to avoid the occurrence of chipping. Hence, by applying the manufacturing method of a sub-mirror according to the second embodiment when manufacturing the sub-mirror 113B provided with the through-hole 113Ba having a longer length dimension, not only can manufacture yield of sub-mirrors be enhanced more readily, but also an excellent sub-mirror having the advantages described above can be manufactured more readily.

While the manufacturing method of a sub-mirror and the manufacturing method of a light source lamp have been described on the basis that the objects to be manufactured by the invention are a sub-mirror, a light source lamp, and a projector, the invention is not limited to the foregoing. For example, the invention can be used widely to manufacture a piercing part as the manufacturing method of a piercing part on the basis that the object to be manufactured is a piercing part, for example, a piercing part for bearings in watches.

To be more specific, the manufacturing method of a piercing part of the invention is a manufacturing method of a piercing part having a concave surface or a convex surface of a plano-circular shape formed on at least one end face, and a through-hole having a central axis that agrees with the central axis of the concave surface or the convex surface, and includes a tube-like member preparing step of preparing a tube-like member having an inside diameter dimension matching with the inside diameter dimension of the through-hole, and a grinding step of forming the concave surface or the convex surface through grinding applied from one end face side of the tube-like member.

Hence, in the manufacturing method of a piercing part of the invention, the tube-like member having the inside diameter dimension matching with the inside diameter dimension of the through-hole has been previously prepared in the tube-like member preparing step, and the piercing part can be thus manufactured using the tube-like member as a starting material. This eliminates the need for a piercing step itself that makes it difficult to enhance manufacturing yield due to the occurrence of chipping. Manufacturing yield, therefore, will not be reduced due to the occurrence of chipping, which can in turn make it easier to enhance manufacturing yield of piercing parts.

In the manufacturing method of a piercing part of the invention, the concave surface or the convex surface formed through grinding can be of either a spherical shape or an aspherical shape.

While the manufacturing method of a sub-mirror, the manufacturing method of a light source lamp, and the projector of the invention have been described by way of the respective embodiments above, the invention is not limited to the embodiments above and can be implemented otherwise in various manners without deviating from the scope of the invention. For instances, modifications as follows are possible.

In the respective embodiments above, the light source lamp 110/110B including the ellipsoidal reflector 114 and the arc tube 112 having the arc portion in close proximity to the focal point $F_1$ of the ellipsoidal reflector 114 is used as the light source lamp. However, it should be understood that the invention is not limited to this configuration, and a light source lamp including a parabolic reflector and an arc tube having the arc portion in close proximity to the focal point of the parabolic reflector can be also used suitably. In this case, the parallelizing lens 116 can be omitted.

The manufacturing method of a light source lamp according to the first embodiment has described a case where the ellipsoidal reflector 114 is attached after the sub-mirror 113 is attached to the arc tube 112. However, it should be understood that the invention is not limited to this order, and the sub-mirror 113 may be attached after the arc tube 112 is attached to the ellipsoidal reflector 114.

The invention claimed is:

1. A manufacturing method of a sub-mirror used for a light source lamp provided with an arc tube, a reflector to reflect light emitted from the arc tube to be emitted toward an illuminated region, and a sub-mirror having a reflection concave surface to reflect the light emitted from the arc tube to the reflector and a through-hole used for attachment to the arc tube, the manufacturing method of a sub-mirror comprising:

preparing a tube-like member having an inside diameter dimension matching with an inside diameter dimension of the through-hole;

forming a concave surface through grinding applied from one end face side of the tube-like member;

polishing the concave surface formed in by grinding; and forming the reflection concave surface by forming a reflection layer within the polished concave surface.

2. The manufacturing method of a sub-mirror according to claim 1, the tube-like member having an outside diameter dimension and a length dimension matching with an outside shape of the sub-mirror.

3. The manufacturing method of a sub-mirror according to claim 1, forming the concave surface including forming a convex surface through grinding applied also from another end face side of the tube-like member.

4. The manufacturing method of a sub-mirror according to claim 3, the concave surface and the convex surface being formed through grinding in such a manner that a length dimension along a first direction parallel to a central axis of the through-hole in an innermost peripheral surface of the tube-like member is longer than a length dimension along the first direction in an outermost peripheral surface of the tube-like member.

5. The manufacturing method of a sub-mirror according to claim 1, an inner surface of the tube-like member being a smooth surface.

6. The manufacturing method of a sub-mirror according to claim 1, further comprising:

roughening an inner surface of the tube-like member.

7. The manufacturing method of a sub-mirror according to claim 1, the reflection layer being formed while an inner surface of the tube-like member is covered with a mask.

8. The manufacturing method of a sub-mirror according to claim 1, the reflection layer being formed while an inner surface of the tube-like member is exposed.

9. The manufacturing method of a sub-mirror according to claim 1, the tube-like member being made of an inorganic material that transmits infrared rays.

10. The manufacturing method of a sub-mirror according to claim 1, the reflection layer being made of a dielectric multi-layer film that transmits infrared rays.

11. A manufacturing method of a light source lamp provided with an arc tube, a reflector to reflect lights emitted from the arc tube to be emitted toward an illuminated region, and a sub-mirror having a reflection concave surface to reflect the lights emitted from the arc tube to the reflector and a through-hole used for attachment to the arc tube, the manufacturing method comprising:

manufacturing a sub-mirror by the manufacturing method of a sub-mirror according to claim 1; and attaching the sub-mirror to the arc tube.

12. The manufacturing method of a sub-mirror according to claim 11, the tube-like member having an outside diameter dimension and a length dimension matching with an outside shape of the sub-mirror.

13. The manufacturing method of a sub-mirror according to claim 11, forming the concave surface including forming a convex surface through grinding applied also from another end face side of the tube-like member.

14. The manufacturing method of a sub-mirror according to claim 11, the concave surface and the convex surface being formed through grinding in such a manner that a length dimension along a first direction parallel to a central axis of the through-hole in an innermost peripheral surface of the tube-like member is longer than a length dimension along the first direction in an outermost peripheral surface of the tube-like member.

15. The manufacturing method of a sub-mirror according to claim 11, an inner surface of the tube-like member being a smooth surface.

16. The manufacturing method of a sub-mirror according to claim 11 further comprising:

roughening an inner surface of the tube-like member.

17. The manufacturing method of a sub-mirror according to claim 11, the reflection layer being formed while an inner surface of the tube-like member is covered with a mask.

18. The manufacturing method of a sub-mirror according to claim 11, the reflection layer being formed while an inner surface of the tube-like member is exposed.

19. The manufacturing method of a sub-mirror according to claim 11, the tube-like member being made of an inorganic material that transmits infrared rays.

20. The manufacturing method of a sub-mirror according to claim 11, the reflection layer being made of a dielectric multi-layer film that transmits infrared rays.

* * * * *